United States Patent [19]

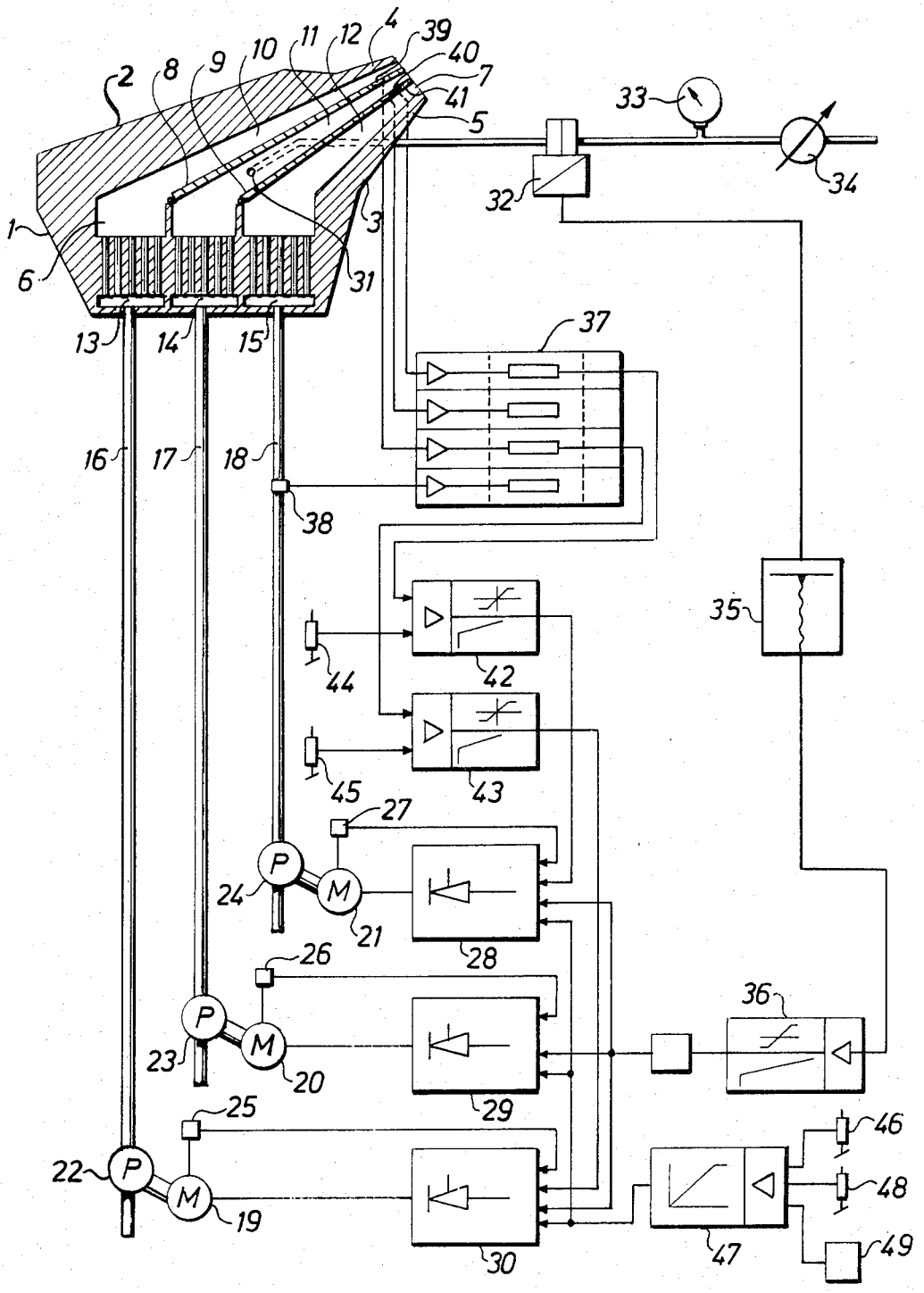
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
P
M

Andersson

[11] Patent Number: 4,526,653

[45] Date of Patent: Jul. 2, 1985

[54] CONTROL SYSTEM FOR A MULTILAYER HEADBOX USING AN ULTRASONIC TRANSDUCER

[75] Inventor: Karl J. L. Andersson, Karlstad, Sweden

[73] Assignee: KMW Aktiebolag, Karlstad, Sweden

[21] Appl. No.: 426,107

[22] Filed: Sep. 28, 1982

[30] Foreign Application Priority Data

Dec. 1, 1981 [SE] Sweden ..... 8107154

[51] Int. Cl.[3] ..... D21F 1/06; D21F 11/04

[52] U.S. Cl. ..... 162/259; 162/343; 162/347

[58] Field of Search ..... 162/252, 253, 259, 347, 162/263, 49, 198, 343, 262; 367/96, 902

[56] References Cited

U.S. PATENT DOCUMENTS

| | | | |
|---|---|---|---|
| 3,598,696 | 8/1971 | Beck . | |
| 3,839,143 | 10/1974 | Suckow . | |
| 3,923,593 | 12/1975 | Verseput . | |
| 4,021,295 | 5/1977 | Schmaeng . | |
| 4,086,130 | 4/1978 | Justus . | |
| 4,210,969 | 7/1980 | Massa | 367/902 |
| 4,374,703 | 2/1983 | Lebeau et al. | 162/259 |

*Primary Examiner*—Steve Alvo

*Attorney, Agent, or Firm*—Bell, Seltzer, Park & Gibson

[57] ABSTRACT

A control system for controlling a multilayer headbox for a paper machine, which headbox there are three channels converging in the direction of flow and through which stock is conducted from separate inlets to discharge slots at the slice opening for discharge of layer-forming stock jets. Each channel is connected by a feed pipeline for stock supply by means of a motor-driven pump, the speeds of which are controlled by individual speed regulator units. The control system includes a first controller, which emits an output signal as a function of a possible deviation of an actual value of the pressure of the stocks inside the headbox from a setpoint for the pressure, which output signal is transmitted to all speed regulator units in order to regulate the speeds of the motors synchronously and, by means of the pumps, to alter synchronously the stock supply to the channels. The control system additionally comprises ultrasonic transducer means arranged in proximity to the slice opening in order to obtain information about the distance between two channel-forming surfaces in respective channels, which distance information is transmitted to an electronic measuring unit connected to the transducer means and also two controllers, which each receive a measurement signal from the electronic measuring unit representing an actual distance value obtained and which compare this actual distance value with a setpoint and, in response to a possible deviation, emit an output signal to the speed regulator unit for the motor which regulates the stock supply to the channel in question.

8 Claims, 1 Drawing Figure

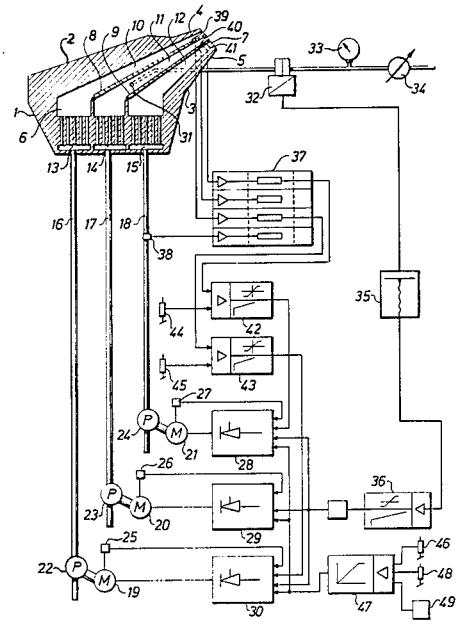

CONTROL SYSTEM FOR A MULTILAYER HEADBOX USING AN ULTRASONIC TRANSDUCER

FIELD OF THE INVENTION

The present invention relates to a control system for controlling a multilayer headbox for a paper machine.

The present invention more particularly relates to a control system for a multilayer headbox of the type which comprises two walls arranged in spaced apart relation from each other and defining a space converging in the direction of flow. The two walls have lip members at the headbox outlet that define a slice opening for discharging stock. In addition, at least one partition is arranged in said space for forming respective channels converging in the direction of flow and which in number are one more than the number of partitions. Stocks are conducted through the channels from separate inlets in the headbox to discharge slots at the slice opening for discharge therefrom of a corresponding number of layer-forming stock jets. Each channel is connected to a feed pipeline for stock supply by means of a motor-driven pump, the speeds of the motors being controlled by individual speed regulator units.

BACKGROUND OF THE INVENTION

Headboxes are included in the wet end of a paper machine and are used to distribute the stock evenly across the width of the wire and to control the discharge so that this takes place at a uniform velocity and in the same direction across the entire width of the wire. With increasingly higher paper machine speeds, there has been a changeover to closed headboxes of the kind described above which operate under pressure. At the same time the size of the headboxes has been able to be limited. While the industry has demanded higher production rates for the paper machines, it also requires that the same high quality standards be maintained. For special headboxes for two or more stock jets, i.e. so-called multilayer headboxes, the higher production speeds involve major problems in producing a paper web of satisfactory quality with regard to desired uniformity of basis weight and thickness of the combined layers. It is therefore of great importance that the desired pressure can be maintained in the headbox and that the heights of the channels, i.e. the distances between two channel-forming surfaces, be kept constant, so that the discharged stock jets will be uniform with respect to velocity and thickness. Multilayer headboxes of this kind are disclosed, for example, in U.S. Pat. No. 3,598,696 (Beck); U.S. Pat. No. 3,839,143 (Suckow); U.S. Pat. No. 3,923,593 (Verseput); U.S. Pat. No. 4,021,295 (Schmaeng) and U.S. Pat. No. 4,086,130 (Justus).

It is known from the aforementioned U.S. Pat. No. 4,086,130 to automatically maintain control of the stock flows passing through the stock channels in the headbox that are intended for the outer layers dependent on the stock flow passing through the stock channel intended for the center layer, in that actual values of the pressure drop between two points located upstream and downstream of a transverse perforated plate or similar perforated partition in the center channel of the headbox are recorded and processed in order to be compared with operational setpoints. It is also known through this patent to control with a controller means the total hydraulic head, so that the desired spouting velocity of the stocks is obtained in relation to the speed of the paper machine wire. This known system is unsatisfactory, however, in that no actual control of the layer thickness is obtained and that if a blockage should occur in one or more tubes or the like in the portion of the headbox aligning the stock flow for the channel in question, this would cause the pressure drop across this portion to increase and the flow through the same to diminish. This increase of pressure drop would be interpreted by the control system as if the flow through the channel was too large and it would therefore reduce the flow still more, an action that is exactly the opposite of that required and one that would also cause the jet velocity from the headbox to be reduced. At a change of the ratio between pressures in the converging portions of the channels, the partitions will be affected so that, if they are self-adjusting dependent on the pressure difference across them, the heights of the channels will be changed and the desired relationship between layer thicknesses can no longer be obtained.

SUMMARY OF THE INVENTION

The object of the invention is to eliminate the problems stated above and to produce a novel control system that makes it possible, even at high speeds, to control accurately the thickness of the layers that are discharged from the headbox at the same time as a desired pressure can be maintained therein and thereby a desired velocity of the component jets and the whole jet out of the headbox.

This is achieved according to the present invention by an improved control system as described below. This control system is used on a multilayer headbox comprising two walls arranged in spaced apart relation from each other and defining a space converging in the direction of flow. The walls have lip members at the headbox outlet which define a slice opening for discharging stock. The headbox additionally includes at least one partition arranged in said space for forming respective channels converging in the direction of flow and which in number are one more than the number of partitions. Through the channels, respective stocks are conducted from separate inlets in the headbox to discharge slots at the slice opening for discharging therefrom a corresponding number of layer-forming stock jets. Each channel is connected to a respective feed pipeline for stock supply, each feed pipeline including a respective motor-driven pump, the speeds of which are controlled by respective individual speed regulator units.

The control system of the present invention comprises a first controller means arranged to emit an output signal as a function of a possible deviation of a quantity indicating an operational condition of the stocks inside the headbox from a setpoint for such quantity. The output signal is transmitted to all of said speed regulator units in order to control the speeds of the motors synchronously and thus, by means of the pumps, synchronously alter the stock supply to the channels. Ultrasonic transducer means is arranged in proximity to the slice opening for obtaining a signal representative of the distance between two channel forming surfaces in at least one channel. An electronic measuring unit is connected to said ultrasonic transducer means and is operable to convert said signal into a distance value. Additionally, at least one other controller means is connected to the electronic measuring unit to receive a measurement signal representing the distance value obtained, and is operable to compare the actual value with a setpoint and, in response to a possible deviation, to emit an output signal of non-inverted value to the speed regulator unit for the motor and pump controlling the stock supply to the channel in question or an output signal of inverted value to the speed regulator unit for the motor and pump controlling the stock supply to the adjacent channel.

BRIEF DESCRIPTION OF THE DRAWING

The invention will now be described in greater detail with reference to the drawing, which shows a block diagram of a control system according to a suitable embodiment.

DESCRIPTION OF ILLUSTRATED EMBODIMENT

A headbox 1 has been shown schematically in the block diagram and is of the kind disclosed in GB No. 2,019,465 (Stenberg) comprising two walls 2, 3 arranged at a distance from each other and with two interacting lip members, which are arranged in the embodiment shown as an upper lip 4 and a lower lip 5. The two opposed walls 2, 3 define a space 6 converging in the direction of flow and which terminates at the lips 4, 5 in a slice opening 7 and which is bound laterally by side walls (not shown). The headbox is arranged in close connection to a paper machine forming zone (not shown) for formation of a paper web, the width of which is determined by the length of the slice opening 7 in a direction across the machine direction. One of the headbox walls, here the upper wall 2 in this position of the headbox, is pivotable about a rear, horizontal axis (not shown) to permit adjustment of desired size of slice opening (the distance between the lips). The upper lip is also provided in the conventional way with a plurality of profile adjustment means (not shown) equally spaced in the cross direction of the headbox for individual local adjustment of the slice opening.

The headbox is of multilayer type and for this purpose is provided with two flat partitions 8, 9, which divide the headbox space 6 into three portions 10, 11, 12 of stock channels converging in the direction of flow. The partitions are attached at their rear ends, e.g. mounted pivotally, in the headbox and desired discharge slots are obtained between their ends located downstream and the upper and lower lips. By means of the two partitions, the slice opening is divided up into three narrow discharge slots.

The headbox is provided at its rear end with three inlets 13, 14, 15, which communicate via a tube bank or the like with the three converging channel portions 10, 11, 12, as shown schematically in the drawing. The inlets are each connected to a feed pipeline 16, 17, 18, which each contain a pump 22, 23, 24 driven by an electric motor 19, 20, 21. The pumps are connected to individual stock supplies (not shown). Alternatively, the pumps for the outer channels 22, 24, for example, can be fed from the same stock supply. The speed of each motor is monitored by a tachometer generator 25, 26, 27, the signal from which is fed back to a speed regulator unit 28, 29, 30, which includes a thyristor and a speed regulator.

During operation, stock is fed by means of the pumps 22, 23, 24 through the feed pipelines 16, 17, 18 to the three separate channels of the headbox through which the stock streams pass under high pressure and are ejected through the discharge slots at the slice opening 7 to be dewatered on a wire or between two wires in the paper machine forming zone and thereby amalgamated into a fiber web made up of three layers. Preferably, the partitions merge beyond the slice opening into gas wedges, preferably air wedges, which have a favorable effect on the stock jets and their combination on the wire.

Further, during operation measurement takes place of an actual value for a quantity indicating the operational condition of the stocks inside and outside the headbox, which operational condition can include several variables such as e.g. velocity and pressure. In the embodiment shown, one side of a d/p cell 32 is connected by a connecting pipe 31 to the converging portion 11 of the center channel of the headbox to measure continuously the pressure of the stock flowing therethrough. The other side of the d/p cell 32 is in communication with a pressure gauge 33 and a valve 34 to a source of compressed gas, usually compressed air. A reference pressure set by means of the valve 34 can be read on the pressure gauge 33 and determines the jet velocity out of the headbox and represents the setpoint. This reference pressure is determined in its turn with the guidance of the machine speed desired, manually or e.g. by computer control. Thus the pressure in the headbox represents the actual value. The deviation between actual value, i.e. the pressure in the headbox and the setpoint is measured with the aid of the d/p cell. Any deviation obtained between actual value and setpoint is converted into a signal, which is proportional to the deviation. The d/p cell is connected, via a recorder 35 showing the pressure deviation in the headbox, to a first controller means with P, PI or PID control, which in the embodiment shown consists of a PI controller 36, in which the signal representing the deviation is amplified and integrated. The PI controller 36 is connected to the three speed regulator units 28, 29, 30. The output signal obtained from the PI controller 36 is added to or subtracted from the respective reference signal from a service potentiometer 46, depending on negative or positive deviation, so that the resultant signal will synchronously actuate all speed regulator units and thereby the speed of all pump motors. A change of speed of the pump motors means that the stock flows from the pumps will be changed to a corresponding degree, which in its turn causes the jet velocities out of the slice opening to be changed synchronously and to a corresponding degree.

Thus the control circuit described above endeavors all the time to attain complete agreement between the setpoint and the actual value and will correct any deviations synchronously for all channels.

In an alternative embodiment that is not shown, the d/p cell is replaced by an absolute-measuring pressure transducer, which is connected through the side wall of the headbox to the center channel. The output signal obtained from this transducer is proportional to the absolute pressure in the headbox (the actual value). The signal giving the setpoint is obtained from a voltage-fed potentiometer or as an output signal from a calculating computer. Actual value and setpoint signals are received by a PI controller, the output signal of which gives an increase/decrease action to all speed regulator units, as described previously.

The block diagram shown also includes a control circuit for controlling the partition positions in the slice opening in relation to each other and in relation to the upper and lower lips 4, 5. This control circuit contains an electronic measuring unit 37 for sound velocity values, to which a reference ultrasonic transducer means 38 is connected. The reference ultrasonic transducer means 38 is arranged in one of the feed pipelines, e.g. in one of the pipelines arranged for the outer channels, and measures the sound velocity in the stock flow in question at the temperature in question and for a definite distance, e.g. 10 mm. The measuring unit has a thumb wheel switch by means of which the sound velocity value is adjusted until the measurement reading from the reference transducer agrees with said definite measuring length. The reference transducer thus provides indirectly a setting of the temperature-dependent sound velocity in the stock (about 1500 m/s) at the working temperature in question.

Three ultrasonic transducer means 39, 40, 41 are mounted in both partitions of the headbox near their downstream ends and are arranged by means of ultrasound to provide information about the distance between two channel-forming surfaces in each of the three separate channels, i.e. the distances between the two partitions 8, 9 and between each of the partitions 8, 9 and the opposed lip 4 and 5, respectively (hereinafter designated "channel heights"). Thus the partitions and the lips present channel-forming surfaces. The ultrasonic transducers are arranged in the partitions level with or slightly inside their surfaces, so that no projecting portions can have a detrimental effect on the stock flow. The ultrasonic transducers are connected by individual coaxial cables to the measuring unit 37, where the measurement results can be read on a digital display. The coaxial cables are suitably arranged inside the partitions and extend to the upstream ends thereof, where they leave the headbox. When the sound velocity value from the reference ultrasonic transducer has been set on the measuring unit 37 so that it indicates said definite length, all measured values from the headbox shown on the measuring unit will be in agreement with reality. The measuring unit is of the kind that measures the channel distances automatically in respective channels according to a definite sequence. The measurement signal from each ultrasonic transducer is processed in the measuring unit, where regard is taken to the preset sound velocity value. A signal is obtained from the measuring unit outputs which is proportional to the measured channel distance. Each output comprises a holding circuit, that holds the output signal value until a new measured value has been obtained. Only the outputs for the two outer channels 10, 12 are used, in that these two outputs of the measuring unit are connected individually to second controller means with P, PI or PID control. Two PI controllers 42, 43 are used in the embodiment shown. The desired setpoint for respective outer channels 10, 12 (can be the same or different, depending on the layer structure required) can be preset with the aid of e.g. a reference potentiometer 44, 45, which is connected to the PI controller 42, 43. The measurement signal, i.e. the actual value, from the respective output of the measuring unit is compared in the PI controller 42, 43 with the setpoint and any deviation of the actual value from the setpoint will be obtained as an output signal from the PI controller 42, 43. The PI controllers are each connected to one of said speed regulator units 28, 30 for the outer channels 10, 12. Said output signal from the respective PI controller is added to or subtracted from, depending on negative or positive deviation, the respective reference signal from the previously mentioned service potentiometer 46, whereby the resultant signal operates the speed regulator unit 28 or 30 in question and thereby the speed of the motor, causing a corresponding change of pump speed. In this way the flow of stock to the channel in question is altered and thereby also the pressure in the channel, which results in a change of partition position, so that the channel height is altered. For example, when the pump speed increases, the stock flow will increase and thereby the pressure in the channel in question, so that the channel height becomes greater.

Thus the control circuit described above endeavors all the time to attain full agreement between the setpoint of each separate channel and its actual value.

The control system also comprises a ramp unit 47, which includes in addition to the previously mentioned service potentiometer 46 a so-called crawl potentiometer 48, which can be switched in by means of a selector switch 49 to control the start-up of the headbox until operating condition is reached, whereupon the service potentiometer 46 is switched in. The ramp unit voltage is applied to all speed regulator units.

In an alternative embodiment, which is not shown, two of the ultrasonic transducers are mounted in each its own lip member, while the third ultrasonic transducer is arranged in one of the partitions.

The ultrasonic transducers are of the kind that comprise a transmitter and a receiver for ultrasound in the form of a piezo-electric crystal, which is connected to the electronic equipment that induces the crystal to emit an ultrasonic pulse and convert into distance information the time taken for the ultrasonic pulse to travel from the crystal through the stock to an opposed surface and back to the crystal.

Consequently, an ultrasonic transducer means in the form of a crystal with the combined function of transmitter and receiver is arranged in one of the members between which a determination of distance shall be made. It is possible, however, to use an ultrasonic transducer means that has these functions divided up between two crystals, one of which is mounted in one of said members as a transmitter while the other crystal is mounted in the other said member as a receiver.

Preferably, the ultrasonic transducers are located at one of the corners of lip members and partition or partitions and as near the front edge of these as possible. The geometrical difference that occurs between the measuring points and the actual discharge slots (the channel height in a direction inwards) should be taken into consideration by the measuring unit through suitable adjustment thereof.

In the embodiment described specifically above, an output signal of non-inverted value is used as response to a possible deviation. In some cases, in particular for a headbox with two channels, this kind of output signal can be converted into an inverted value. For example, an output signal representing a negative deviation recorded for one of the channels is converted into an inverted value, which will then represent a positive deviation for the other, adjacent channel, the pertaining speed regulator unit and pump motor of which will be operated to produce a change in stock flow in this second channel instead of in the first channel, in which measurement with ultrasound has taken place.

Further, it is possible, if so desired, to replace the reference ultrasonic transducer 38 by, for example, a readout of the stock temperature in combination with a setting of the electronic measuring unit 37 for the sound velocity corresponding to the temperature reading. It is also possible—in a case where only the relation between the channel heights must be kept constant and the absolute values of the channel heights are allowed to vary with the temperature—to dispense with temperature compensation of the measured distance, so that the reference transducer 38 can be eliminated.

That which is claimed is:

1. In a multilayer headbox for a paper machine, said headbox comprising two walls arranged in spaced apart relation from each other and defining a space converging in the direction of flow, said walls having lip members at the headbox outlet that define a slice opening for discharging stock, said headbox additionally including at least one partition arranged in said space for forming respective channels converging in the direction of flow and which in number are one more than the number of partitions, through which channels respective stocks are conducted from separate inlets in the headbox to discharge slots at the slice opening for discharging therefrom a corresponding number of layer-forming stock jets, each channel being connected to a respective feed pipeline for stock supply, each feed pipeline including a respective pump driven by a motor, the speeds of which motors are controlled by respective individual speed regulator units, the combination with said multilayer headbox of an improved control system for accurately controlling the thickness of the layers formed by said headbox, said control system comprising a first controller means arranged to emit an output signal as a function of a possible deviation of a quantity indicating an operational condition of the stocks inside the headbox from a setpoint for such quantity, which output signal is transmitted to all of said speed regulator units in order to control the speeds of the motors synchronously and thus, by means of the pumps, synchronously alter the stock supply to the channels, ultrasonic transducer means arranged at the slice opening for transmitting an ultrasonic pulse through the stock to an opposed channel forming surface to thereby obtain a signal representative of the distance between two channel-forming surfaces in at least one channel, an electronic measuring unit connected to said ultrasonic transducer means to convert said signal into a distance value, and at least one other controller means connected to said electronic measuring unit to receive said measurement signal representing the distance value obtained between said two channel-forming surfaces in said at least one channel and operable to compare the actual value with a setpoint and, in response to a possible deviation, to emit an output signal to one of said speed regulator units in order to control the speed of the pump motor and thereby vary the stock supply to one of said channels relative to the stock supply to the adjacent channel.

2. A control system according to claim 1, wherein said ultrasonic transducer means are arranged in two adjacent channels in order to obtain, by means of ultrasound through the stock, information about the distance between two channel-forming surfaces in each of the two adjacent channels.

3. A control system according to claim 1, wherein said ultrasonic transducer means are arranged in three adjacent channels in order to obtain, by means of ultrasound through the stock, information about the distance between two channel-forming surfaces in each of the three adjacent channels, and wherein said first controller means is operable for measuring said operational condition of the stock flowing through the center channel, and wherein said at least one other controller means is arranged in each of the outer channels to receive a measurement signal representing an actual distance value in its own outer channel, and each of said other controller means including means to compare such actual distance value with a setpoint and to emit its own output signal in response to possible deviations from the setpoint, and means to direct such output signal to its pertaining speed regulator unit for the motor and pump controlling the stock supply to the outer channel for which a deviation has been measured.

4. A control system according to any one of claims 1–3, additionally comprising a reference ultrasonic transducer means arranged in one of the feed pipelines to the headbox for checking the sound velocity in the stock at different temperatures, which ultrasonic transducer means is connected to said electronic measuring unit, and is arranged to measure the travel time of an ultrasonic pulse for a specific distance by means of ultrasound through the stock in order to adjust the electronic measuring unit to indicate actual distance values for the headbox channels while taking into consideration the sound velocity value at the working temperature of the stock.

5. A control system according to any one of claims 1–3, wherein each ultrasonic transducer means comprises a transmitter and receiver for ultrasound in the form of a piezo-electric crystal, and wherein said electronic measuring unit includes means for inducing the crystal to emit an ultrasonic pulse and to convert into a distance value the travel time of the ultrasonic pulse from the crystal through the stock to an opposed surface and back to the crystal.

6. A control system according to claim 1, wherein said at least one other controller means produces an output signal of noninverted value with respect to a zero point and is connected to the speed regulator unit for the motor controlling the stock supply to said one channel for thereby varying the stock supply to said one channel.

7. A control system according to claim 1, wherein said at least one other controller means produces an output signal of inverted value with respect to a zero point and is connected to the speed regulator unit for the motor controlling the stock supply to the adjacent channel to said one channel for thereby varying the stock supply to such adjacent channel relative to the stock supply to said one channel.

8. In a multilayer headbox for a paper machine, said headbox comprising two walls arranged in spaced apart relation from each other and defining a space converging in the direction of flow, said walls having lip members at the headbox outlet that define a slice opening for discharging stock, said headbox additionally including at least two partitions arranged in said space for forming respective channels converging in the direction of flow and which in number are one more than the number of partitions, through which channels respective stocks are conducted from separate inlets in the headbox to discharge slots at the slice opening for discharging therefrom a corresponding number of layer-forming stock jets, each channel being connected to a respective feed pipeline for stock supply, each feed pipeline including a respective pump driven by a motor, the speeds of which motors are controlled by respective individual speed regulator units, the combination with said multilayer headbox of an improved control system for accurately controlling the thickness of the layers formed by said headbox, said control system comprising a first controller means arranged to emit an output signal as a function of a possible deviation of a quantity indicating an operational condition of the stocks inside the headbox from a setpoint for such quantity, which output signal is transmitted to all of said speed regulator units in order to control the speeds of the motors synchronously and thus, by means of the pumps, synchronously alter the stock supply to the channels, ultrasonic transducer means arranged in at least two adjacent channels at the slice opening for obtaining, by means of ultrasound through the stock, respective signals representative of the distances between two channel-forming surfaces in at least two adjacent channels, and wherein said first controller means is operable for measuring said operational condition of the stock flowing through an inner channel, an electronic measuring unit connected to said ultrasonic transducer means and operable to convert said signal into a distance value, and at least one other controller means arranged in an outer channel to receive a measurement signal representing an actual distance value in its own outer channel, and each of said other controller means including means to compare such actual distance value with a setpoint and to emit its own output signal in response to possible deviations from the setpoint, and means to direct such output signal to its pertaining speed regulator unit for the motor and pump controlling the stock supply to the outer channel for which a deviation has been measured.

* * * * *